United States Patent [19]

Krause

[11] Patent Number: 4,684,115

[45] Date of Patent: Aug. 4, 1987

[54] MACHINE TOOL VICE

[75] Inventor: Ludwig Krause, Waltenhofen, Fed. Rep. of Germany

[73] Assignee: Saurer-Allma GmbH, Kempten, Fed. Rep. of Germany

[21] Appl. No.: 942,019

[22] Filed: Dec. 12, 1986

Related U.S. Application Data

[63] Continuation of Ser. No. 784,105, Oct. 4, 1985, abandoned.

[30] Foreign Application Priority Data

Oct. 24, 1984 [DE] Fed. Rep. of Germany ..... 3438900

[51] Int. Cl.[4] ..... B25B 1/10

[52] U.S. Cl. ..... 269/136; 269/247; 269/282

[58] Field of Search ..... 269/244, 247, 283, 280, 269/282, 136, 138, 20, 32

[56] References Cited

U.S. PATENT DOCUMENTS

| | | | |
|---|---|---|---|
| 990,186 | 4/1911 | Berg | 269/247 |
| 1,908,748 | 5/1933 | Grant | 269/247 |
| 4,070,010 | 1/1978 | Brasca | 269/247 |
| 4,078,782 | 3/1978 | Carlson | 269/283 |
| 4,232,857 | 11/1980 | Bezubik et al. | 269/244 |
| 4,413,818 | 11/1983 | Lenz | 269/244 |

FOREIGN PATENT DOCUMENTS

| | | | |
|---|---|---|---|
| 1191182 | 10/1959 | France | 269/136 |

*Primary Examiner*—Robert C. Watson
*Attorney, Agent, or Firm*—Holman & Stern

[57] ABSTRACT

The invention relates to a machine tool vice having a vice body and a slide guided in the vice body, with a clamping mechanism working between the vice body and the slide, in which there are two jaws, which are connected with the vice body and the slide respectively and of which the fixed jaw is designed in a bridge-like design and secured such that it can be detached. The clamping mechanism is arranged beneath the clamping zone formed by the jaws, and the slide is arranged in a longitudinal recess, open at the top, and extending generally over the entire length of the vice body. The vice body or the slide is provided with several means of retention which can be used selectively for the jaws. Alternatively several interchangeable jaws be used selectively, and all jaws are mounted on the vice body and the slide such that they can be detached.

5 Claims, 10 Drawing Figures

MACHINE TOOL VICE

This is a continuation of application Ser. No. 784,105, filed Oct. 4, 1985, now abandoned.

BACKGROUND OF THE INVENTION

The invention relates to a machine tool vice having a vice body and a slide guided in the vice body, with a clamping mechanism acting between the vice body and the slide and having two jaws, which are connected with the vice body and the slide respectively.

It is known, for example, from West German patent specification No. 49 814 for the clamping mechanism of a vice viz. the clamping spindle, to be arranged in the plane of the two jaws. The fixed jaw attached to the vice body is slidable on a slide way and may be fixed by means of a pin in any of several predetermined positions. Thus, the clamping distance (opening distance of the jaws) of the vice can be altered and thus adapt to the dimensions of the workpieces.

A vice is described in West German Patent Specification No. 12 78 965 for which the fixed jaw is rigidly fixed to the vice body. The clamping mechanism i.e. the threaded spindle, is situated beneath the plane of the jaws, and the movable jaw is connected by means of a threaded link and a twisting connecting member, subjected to tension with the slide, so that during clamping operations downwardly twisting forces are induced.

A machine tool vice of the type mentioned above is also described in West German Patent Specification No. 11 41 600, with which it is possible to additionally exert the clamping force on to the clamping mechanism i.e. the thread spindle, by a compressed air system, in order to increase the clamping forces in the clamping position.

The fixed jaw is connected by a screw fastening with the vice body. Interchangeable clamping pieces are provided in the operable face of the clamping jaws on this type of design and also in other types of vice designs, which, as items subject to wear, are interchangeable and which also permit conformity with the workpiece in question with regard to profile or its surface finish.

BRIEF DESCRIPTION OF THE INVENTION

Apart from interchangeability of the clamping pieces, plus the facility of being able to vary the clamping distance, a feature common to all known vices is that they fail to conform to the particular conditions of the respective workpieces or the machining operations. It is, therefore, an object of the invention to design a machine tool vice, such that compatibility with the workpieces or the machining processes is considerably improved, whereby the design can enable such compatibility to be achieved at the work station.

To resolve this task, the invention provides a machine tool vice comprising a vice body, a slide guidably movable in the vice body, a clamping mechanism operating between the vice body and the slide, two jaws operable by the clamping mechanism, one of said jaws being mounted upon the vice body as a fixed jaw and the other of said jaws being mounted upon the slide, a clamping zone arranged between the jaws, said clamping mechanism being arranged below said zone, a recess formed in the vice body to receive said slide, said recess opening upwardly and extending over the entire length of the vice body, and retention means suitable for retaining the said jaws mounted upon the vice body and upon the slide respectively, said retention means being releasable and capable of accepting interchangeable jaws of various configurations in a selective manner.

Since only one jaw could previously be detached in the case of the machine tool vice of the known types and since this design was only provided for reasons associated with construction, the invention proceeds from the concept that the vice body together with the slide and the clamping mechanism are joined to form a basic body, which forms a unit on to which the pairs of jaws can be mounted selectively to suit the requirements in question.

It is obvious that through the proposals in accordance with the invention the jaws can be arranged at a distance from each other such that an extremely large clamping distance is achieved even if it is no longer possible with such a jaw arrangement to clamp small workpieces. For this situation, other jaws can be used or even other retaining means.

With the use of the present invention, it is particularly simple to clamp workpieces internally, using the same machine tool vice to hold workpieces, for example by means of openings provided, whereby the jaws move away from each other during the clamping operation. Consequently, if required, special jaws may be used or even the normal jaws can which usually grip a workpiece externally.

The invention can, above all, be used for those machine tool vices which are designed as high pressure clamping devices. Here, the clamping mechanism comprises additionally a force intensifier (slave or servo-like unit), as is described for example in West German Patent Specification No. 23 08 175. Other force intensifiers can be used, for example, hydraulic force intensifiers.

The force intensifiers are operable when the jaws lies against the workpiece and induce a very high clamping pressure which holds the workpiece positively. The force intensifier for an example of the present invention may also be arranged as part of the clamping mechanism beneath the clamping area determined by the clamping jaws.

Further advantageous embodiments of the invention are incorporated in the features of the sub-claims.

It is clearly important for the invention that the clamping jaws mountable on the basic body are joined to the basic body or slide, such that no further clamping discrepances will arise due to the separable clamping jaw arrangements adopted as per the invention. In order to ensure this, the invention proposed a method for fixing the jaw to the vice body or slide of a machine tool vice, which utilises a keyway and key joint, fixed with screws, and having right angled or sloped supporting faces, in which after keying together, and after insertion of the screws, the high pressure clamping device is then activated and, whilst in the clamped position, the screws are tightened with the required torque.

This type of fixing of the jaw is recommended primarily for the fixed jaw of the machine tool vice of the invention arranged on the vice body.

The invention thus ensures that this fixed jaw is absolutely and perfectly interlocked and at a position which conforms to the working conditions almost exactly. This prevents displacement taking place under the effect of the force intensifier between the jaw and vice body. A further advantage is that this kind of fixing can easily be accomplished with the resources of the work station.

BRIEF DESCRIPTION OF THE DRAWINGS

In the drawings are illustrated diagrammatically several embodiments by way of example.

In the drawings.

DETAILED DESCRIPTION OF THE DRAWINGS

Figure 1:
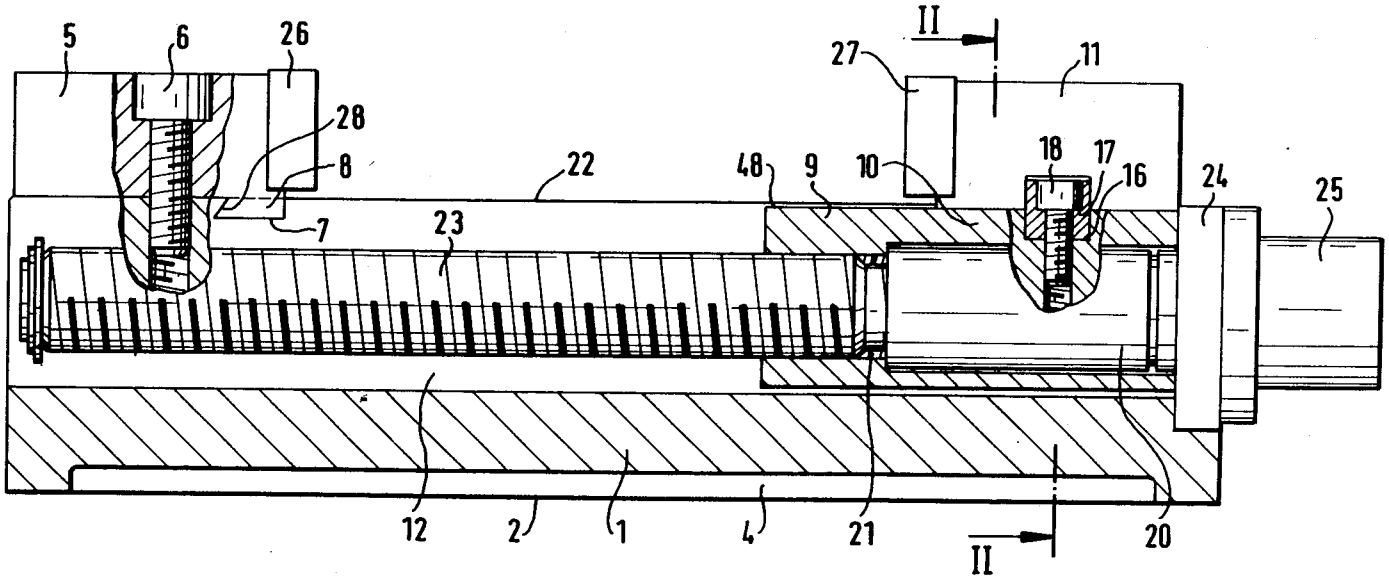
FIG. 1 shows a longitudinal section through a machine tool vice designed as a high pressure clamping device according to the invention.
Figure 2:
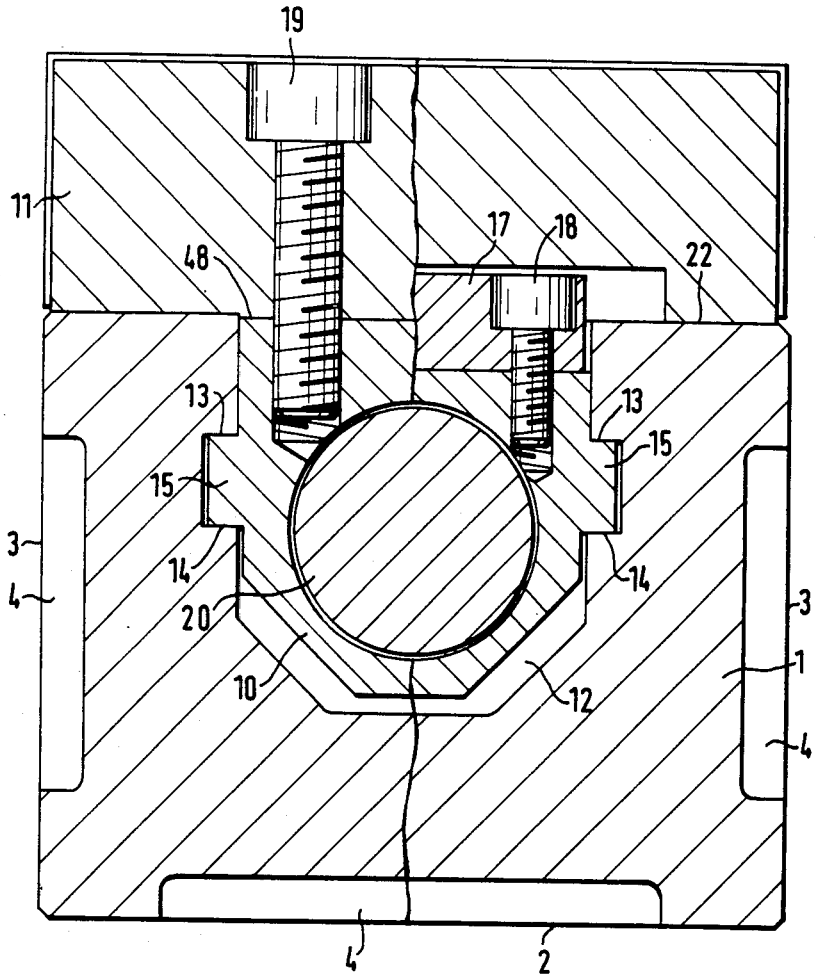
FIG. 2 shows a section through the view of FIG. 1 taken on section line II—II to an enlarged scale.

The vice body 1 has a generally square external profile, as may be seen in FIGS. 1 and 2. Recesses 4 are provided in a bearing surface 2 and in the side faces 3, which enable the fitting of fastening devices for the fixing of the machine tool vice or the high pressure clamping device on to the work table of a machine tool.

FIG. 2 shows clearly that the vice body has a U-shaped form in cross section, by which the necessary rigidity is achieved.

The fixed jaw 5 is mounted on the left-hand end, as viewed in FIG. 1, of the vice body 1 and held by several screws 6. A key 8 attached firmly to the jaw 5 engages in the keyway 7. To the jaw 5 is fitted a clamping piece 26 which is fitted to the jaw 5 and the piece 26 may be designed, for example, to be interchangeable and adapted to suit the respective form of the workpiece, as is known per se. The same applies to a clamping piece 27 of a movable jaw 11.

In a longitudinal recess 12, which in the present example extends over the entire length of the vice body 1, is received a slide 10. Guide tenons 15 of the slide move with respect to guide faces 13 and 14, which are machined in the recess 12. The slide 10 is moved by a threaded spindle 23. The threaded spindle 23 operates together with the spindle nut 21 in the slide 10. The spindle nut 21 is formed in a projection 9 of the slide 10, which extends in a direction from the jaw 11 towards the fixed jaw 5.

The slide 10 carries a key 17 in a transverse keyway 16, the key being secured by two screws 18. The key 17 is used as a support element for the movable jaw 11 which in turn is secured by screws 19 to the slide.

The threaded spindle 23 can be turned through the force intensifier 20 and is driven via the sleeve 25 by a crank (not shown). A force intensifier 20 is supported on a reaction block 24, which is firmly attached to the vice body 1 and borders the recess 12 on one side.

Since the fixed jaw 5 has a bridge-like form, in which the key 8 forms part of this bridge, and consists of two portions entering end regions of the keyway 7, the projection 9 of the slide 10 thus being able to enter into the space under the fixed jaw 5, so that the clamping pieces 26 and 27 can clamp workpieces having the smallest of dimensions.

It should be emphasised that the top edge 22 of the vice body 1 is at generally the same level of height as the top edge 48 of the slide 10. It is obvious, that when the two jaws 5 and 11 are disassembled and the key 17 removed, a basic body essentially having a level surface is obtained, in which this basic body consists of the vice body 1 with the slide 10 and the clamping mechanism comprising the elements 23 and 20.

In the embodiment illustrated in FIGS. 1 and 2 the keyway 7 and key 8 are provided with sloping support surfaces 28 for fixing the fixed jaw 5, whilst the key 17 is used to support the movable jaw 11. This arrangement is to be preferred, because the key 8 can be inserted without further ado with the slide 10 drawn back. It is intrinsically possible to exchange the indicated types of fixing, but less to be preferred on account of the problems associated with assembly which would require additional recesses.

In assembling the fixed jaw 5 in the keyway 7, the task is carried out by initially inserting the fixed jaw 5 together with the key 8 into the keyway 7. The support face 28 between the flank of the key 8 and the side of the keyway is sloped, such that in loading the jaw 5 a force is produced which presses the jaw 5 downwards against the vice body. The support face can be directed at right angles to the direction of clamping.

Figure 10:
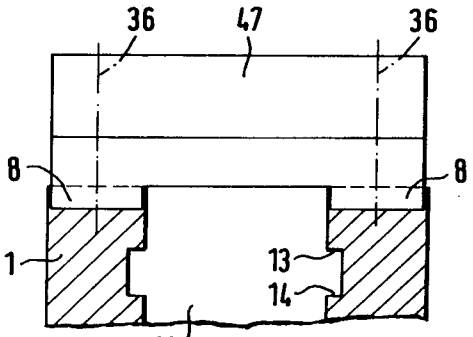
FIG. 10 is a partial section through the view of FIG. 8, taken on section line X—X.

It should be mentioned that the key 8 is adapted to suit equally either of the two legs of the U-shaped form of the vice body 1 and that in the intermediate part, space is left in the recess 12 for the slide 10, as is depicted in the illustration of FIG. 10.

After inserting the jaw 5 in the keyway 7 the screws 6 are fitted and partially tightened. With or without the workpiece being inserted, a clamping force is then applied by the movable jaw 11 and the clamping mechanism, which consists of the threaded spindle 23 and the force intensifier 20, the clamping force corresponding approximately to the force of clamping when used in operation. The screws 6 are then tightened to the predetermined maximum torque. By this there is no appreciable added inaccuracy due to the detachably arranged jaw 5, even in practical use.

It will be noted that the above-described process for fixing the jaw 5 basically has advantages when it is utilised in other situations. The chief advantages are, however, embodied in association with the main concept of the invention, being that all the jaws are detachable and interchangeable.

Figure 3:
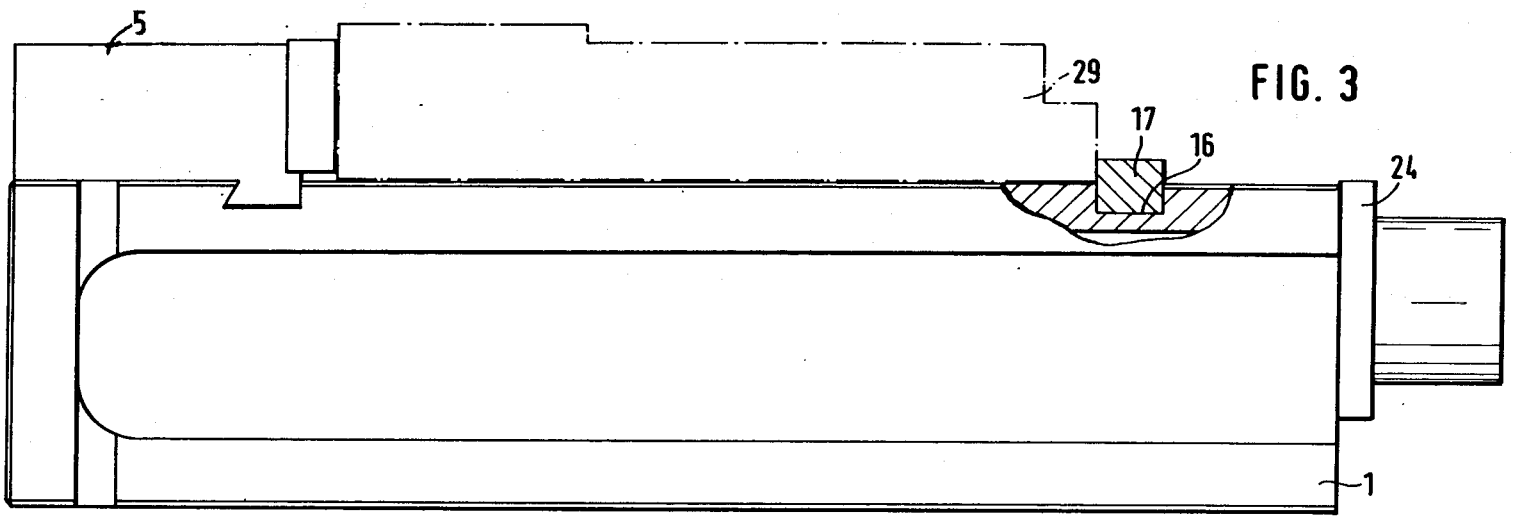
FIG. 3 is a side view, partially in section of an example of an application of the invention.

When the jaw 11 is disassembled, in other words when the screw of screw 19 are loosened, the key 17 can be used as a jaw on its own, as is indicated in FIG. 3. This has the advantage that the workpiece 29 which is shown in chain-dotted line in FIG. 3 is easily accessible from several sides, as is often required at machining stations.

Figure 4:
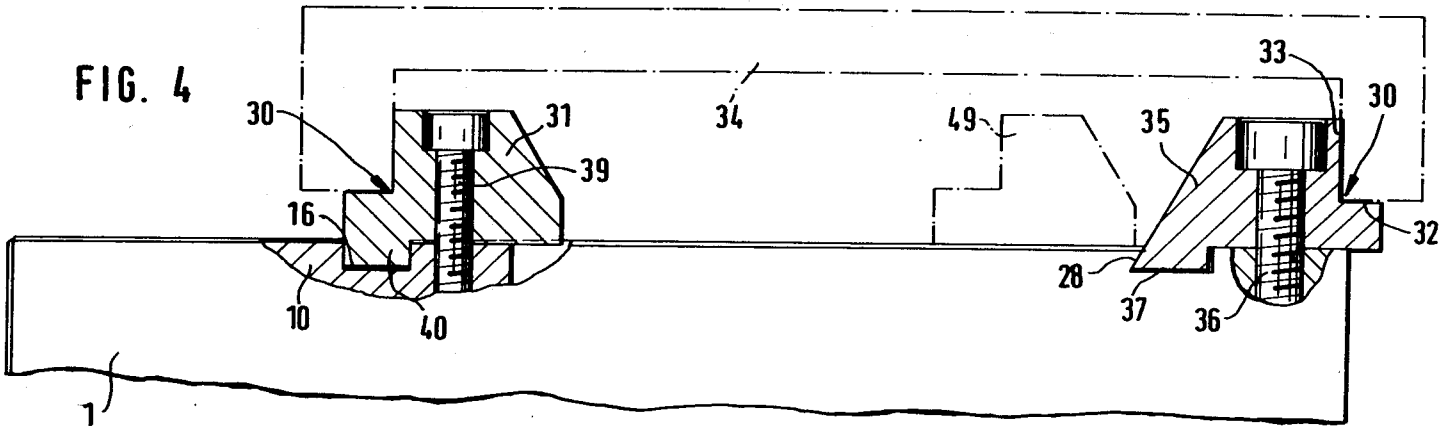
FIGS. 4 to 7 are side views of various examples of applications and embodiments of the invention.

As a rule, the machine tool vice, according to the invention envisages that a further keyway 37 is provided on one end of the vice body, as shown in FIG. 4, being additional to the locating keyway 7 for the fixed jaw 5 on the other end of the vice body 1 and additional to keyway 16 for the key 17 of the movable jaw 11, as shown in FIG. 1 where the keyway 7 is depicted on the left hand end, while the slide 10 is shown in the right hand end in the retracted position.

In utilising the fixed jaw 35 of FIG. 4, the movable jaw 11 with its associated parts, in particular the key 17 is demounted and the movable jaw 31 is assembled in the keyway 16 of the slide 10 by means of the screw 39, the jaw featuring the same step 30 as the fixed jaw 35. The slide 10 is in a forward position in comparison to the illustration of FIG. 1, whereby, it will be advantageously noted, the vice body 1 has essentially a through recess 12, which enables the slide 10 to be pushed forward into a suitable position.

It is obvious that it is possible by means of the two jaws 31 and 35 to clamp a workpiece internally, as shown by the chain dotted lines 34 in the illustration of FIG. 4, whereupon the clamping mechanism with regard to the threaded spindle 23 and the force intensifier 20 remains unaltered.

A possible position of the jaw 31 is further indicated by the chain dotted lines 49, in order to clarify how close the two jaws 31 and 35 can be pushed together, in order, if need be, to clamp small workpieces.

Figure 5:
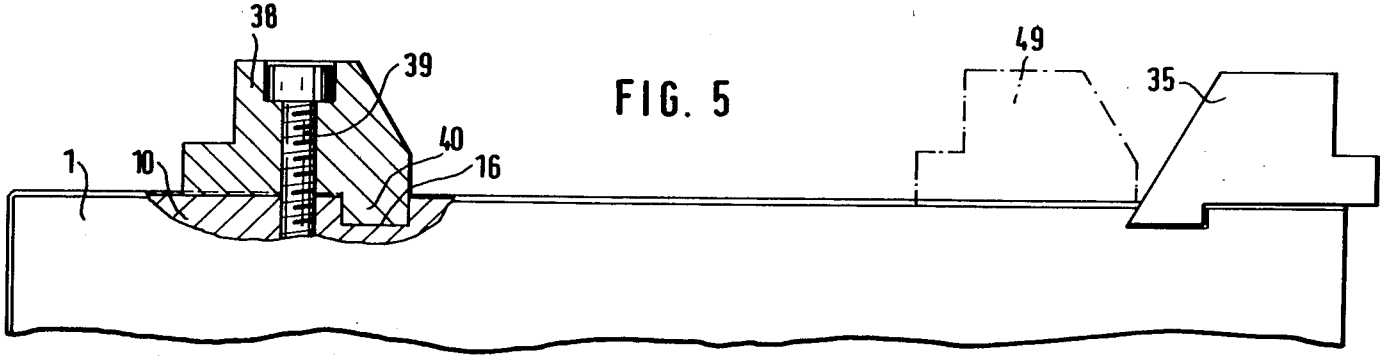

The example of FIG. 5 differs basically from that of FIG. 4 by the design of the indicated movable jaw 38 for which the key 40 engaging in the keyway 16 is arranged on the other side of the hole for the screw 39, so that on arranging a corresponding threaded opening in the slide 10, the clamping distance for a workpiece can be increased still further in comparison to FIG. 4.

Figure 6:
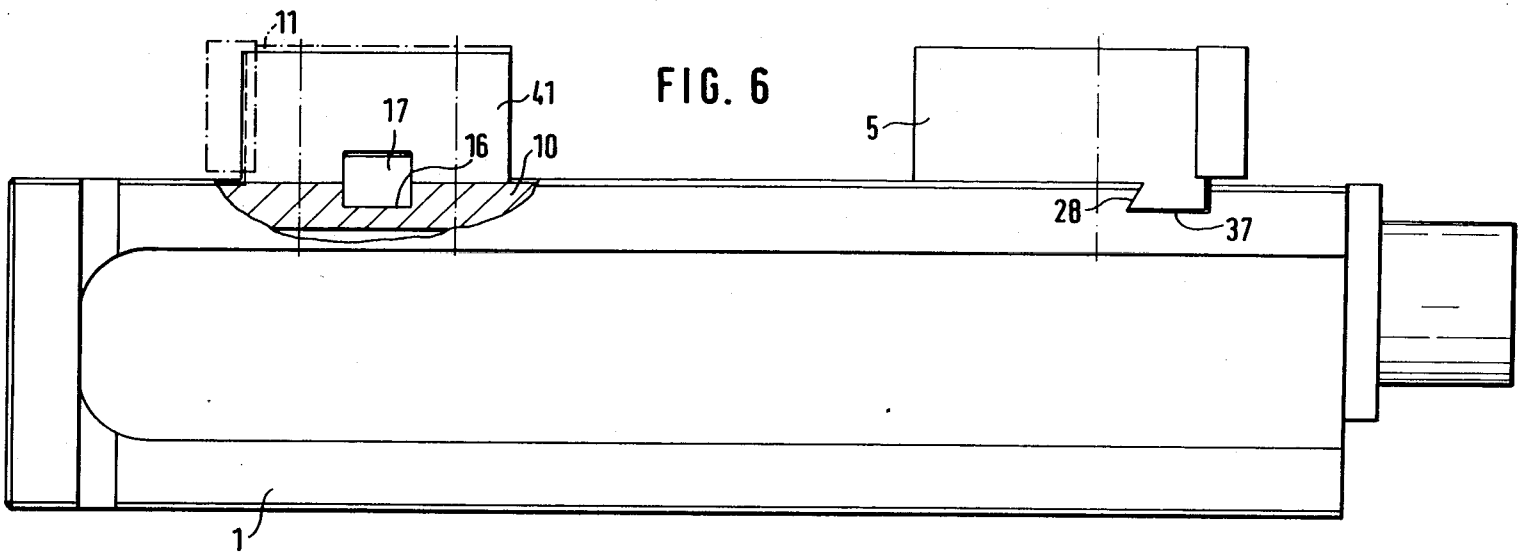

The example in. acordance with FIG. 6 differs basically from the example of FIG. 4 by the fact that the keyway 37 receives the jaw 5, which was also used for the example of FIG. 1. The keyway 16 of the slide 10 can once again accept the movable jaw 11, as is indicated by the chain dotted lines, or alternatively another modified jaw 41, as appropriate for special purposes.

Figure 7:
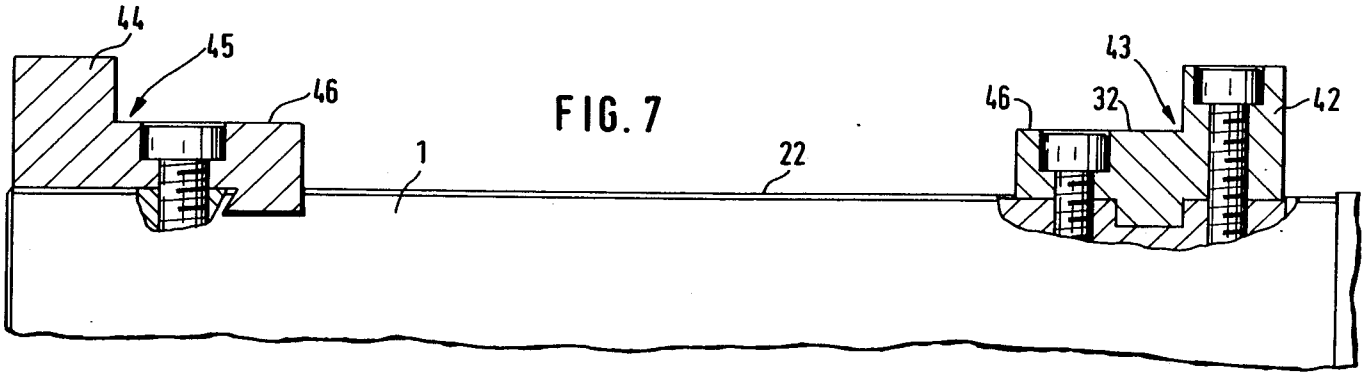

In the embodiment in accordance with FIG. 7 the slide is situated in the approximate position as in FIG. 1, and carries a movable jaw 42 having steps 43, designed in a similar manner to the step 30 (FIG. 1). The fixed jaw 44 is provided with a similar step 45. The arrangement of FIG. 7 enables a workpiece to be clamped from the outside, whereby bearing faces 46 are provided in each case, which provide a clearance from the top edge 22 of the vice body 1. For certain machining situations, for example, on the underside of the workpiece, this is of advantage.

Figure 8:
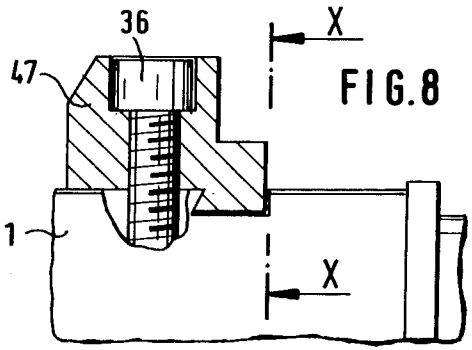
FIG. 8 shows a method of fixing a fixed jaw.

In FIG. 8 is shown another example of a fixed jaw 47, which shows a step 30 corresponding to FIG. 4 and wherein the fixing screw 36 by comparison is relieved of pressure during clamping.

Figure 9:
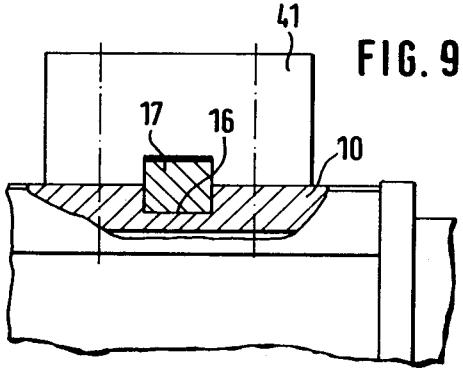
FIG. 9 illustrates an embodiment of the design of a movable jaw.

FIG. 9 shows a further example, whereby the movable jaw 41 (see FIG. 6) is received by means of the key 17 in the keyway 16 of the slide 10, and the movable jaw is in the retracted position, similar to the movable jaw 11 in FIG. 1, in order to operate in conjunction with a fixed jaw on the other end of the vice body 1.

In the indicated examples the means of retention of the jaws are formed in each case by keyways or grooves, in which keys engage. The means of retention can, however, be of another design, e.g. as steps or holes.

I claim:

1. A machine tool vice comprising a vice body, a slide guidably movable in the vice body, a clamping mechanism operable by the clamping mechanism, one of said jaws being mounted upon the vice body as a fixed jaw and the other of said jaws being mounted upon the slide, a clamping zone arranged between the jaws, said clamping mechanism being arranged below said zone, the clamping zone and both jaws being disposed above top edges of the vice body and the slide, a recess formed in the vice body to receive said slide, said recess opening upwardly and extending over the entire length of the vice body, and retention means suitable for retaining the said jaws mounted upon the vice body and upon the slide respectively, said retention means being releasable and capable of accepting interchangeable jaws of various configurations in a selective manner;

the fixed jaw having a bridge-like configuration in the region of its mounting;

the vice body having a generally U-shaped form surrounding the upwardly opening recess;

the top edge of the vice body and the top edge of the slide having approximately the same level of height;

said recess including a pair of guide faces adapted to slideably support said slide;

the guide faces for the slide being elements of the vice body;

the guide faces in the recess cooperating with guide tenons which are part of the slide.

2. A machine tool vice as claimed in claim 1, wherein the movable jaw is supported on a key let into the slide, whereby the key is of such a size that the key alone may be used as a jaw.

3. A machine tool vice as claimed in claim 1, wherein the fixed jaw is secured by screws in a key and groove arrangement, which has or sloping contact faces.

4. A machine tool vice as claimed in claim 1, wherein two identical means of retention for the jaws are provided at the opposite ends of the vice body.

5. A machine tool vice as claimed in claim 1, wherein the jaws are formed in a step-like manner and have a bearing face for the workpiece.

* * * * *